United States Patent [19]

Randle

[11] Patent Number: 4,793,481

[45] Date of Patent: Dec. 27, 1988

[54] BALL CARRIER

[76] Inventor: Redell Randle, 156 W. Chanslor Ave., Richmond, Calif. 94801

[21] Appl. No.: 197,425

[22] Filed: May 23, 1988

[51] Int. Cl.[4] ..... B65D 85/58

[52] U.S. Cl. ..... 206/315.9; 211/14; 221/306; 312/49

[58] Field of Search ..... 206/303, 315.1, 315.9; 211/14, 162, 59.2; 221/306–311, 312 B, 312 C, 312 R; 224/274, 919; 273/25, 29 R, 148 R; 312/45, 49

[56] References Cited

U.S. PATENT DOCUMENTS

| | | | |
|---|---|---|---|
| 1,421,955 | 7/1922 | Kemp | 206/315.9 |
| 2,024,484 | 12/1935 | Smith | 224/919 |
| 2,125,000 | 7/1938 | Considine | 211/14 |
| 2,299,403 | 10/1942 | Mozel | 312/49 |
| 2,394,606 | 2/1946 | Gazda | 312/45 |
| 2,667,118 | 1/1954 | Nelson | 312/49 |
| 2,818,978 | 1/1958 | Post | 211/59.2 |
| 2,880,906 | 4/1959 | Probasco | 221/312 C |
| 3,371,795 | 3/1968 | Rosonke | 211/14 |
| 3,998,335 | 12/1976 | Rodolpho | 211/59.2 |
| 4,398,716 | 8/1983 | Argibay, Jr. et al. | 221/310 |

FOREIGN PATENT DOCUMENTS

| | | | |
|---|---|---|---|
| 296835 | 9/1928 | United Kingdom | 312/49 |

*Primary Examiner*—Jimmy G. Foster

*Attorney, Agent, or Firm*—Bielen and Peterson

[57] ABSTRACT

A carrier for holding and facilitating handling of a plurality of baseballs. The carrier is in the form of a toroidal raceway provided by a plurality of annular rods which define the inner and outer peripheral limits of the raceway. A spring loaded gate is included along the outer periphery of the raceway to permit insertion and removal of balls from the raceway.

8 Claims, 1 Drawing Sheet

FIG-1
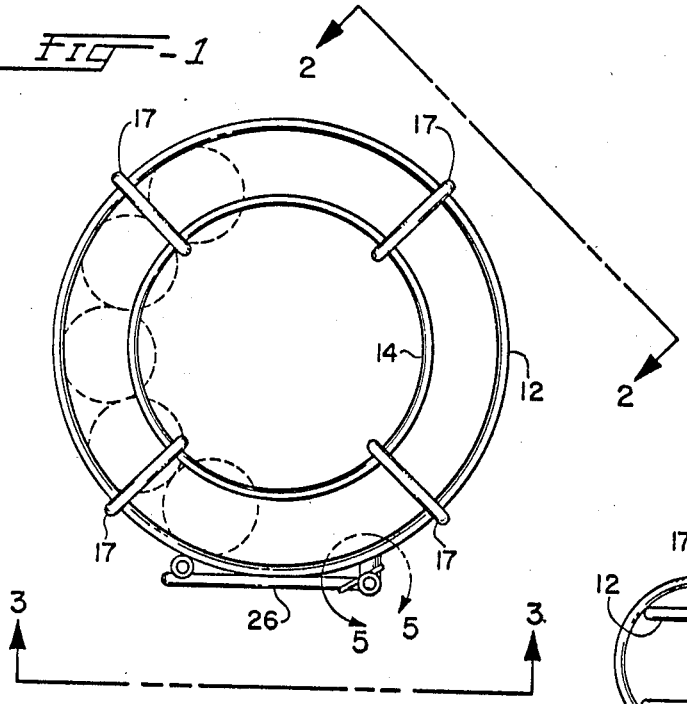
FIG-2
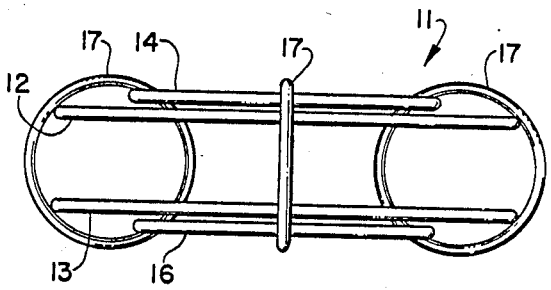
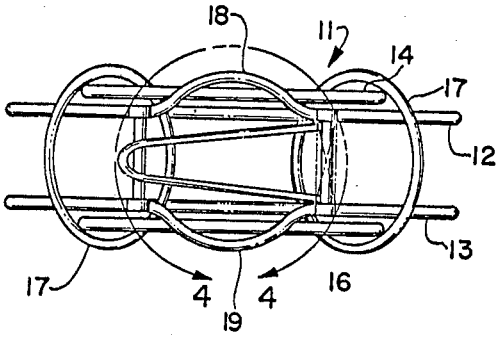
FIG-3
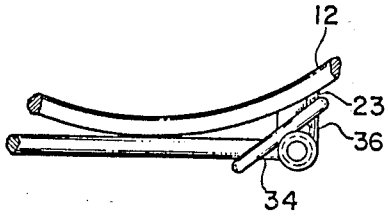
FIG-5
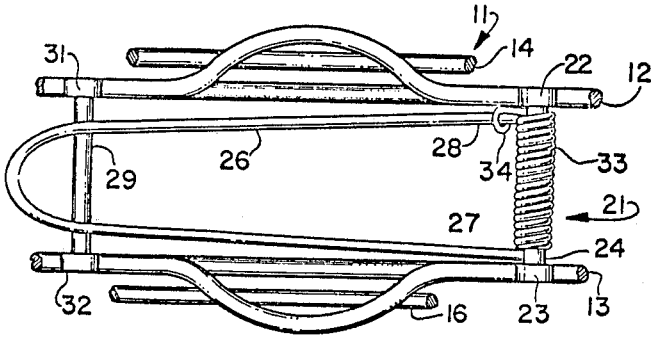
FIG-4

BALL CARRIER

BACKGROUND OF THE INVENTION

The present invention relates to a carrier for holding a plurality of baseballs or the like, and it relates more particularly to a portable ball carrier or caddy that is simple and inexpensive and permits insertion into and removal from the carrier of any one ball without disturbing other balls and especially without the necessity of removing one or more balls from the carrier in order to obtain access to any particular ball.

While only one baseball at a time is necessary to play the game of baseball, it is most often desired to have a substantial number of balls available during a game and during practice sessions. For example, entire baseball games between major league teams are played with relatively new and unscuffed balls, and new balls are kept on hand to replace any playing ball which become scuffed, otherwise damaged, or lost. Moreover, more than one ball is used during warm-up, batting and pitching practice, etc, and used balls are often satisfactory for such purposes.

Since it is not easy for an individual to handle and carry a plurality of balls at any one time in view of their spherical shape and size, various carriers have been provided in the past to hold a plurality of balls and allow the same to be carried onto and off a playing field. Many of such carriers, though, suffer from one or more deficiencies. For example, simpler carriers are basically in the form of baskets or the like, and it will be appreciated that it a particular ball (such as a new one) is desired, one must sort through all of the balls to find the same. Other carriers which allow one to selectively choose a ball without the necessity either of sorting through a plurality of balls for the same or of emptying all of the balls from the carrier are generally too complicated and expensive to meet with commercial success.

SUMMARY OF THE INVENTION

The present invention is a carrier for holding a plurality of balls and the like which is quite simple and inexpensive to construct and yet enables easy visual inspection of the balls and selection of any particular ball for removal from the carrier without requiring the other balls to be removed therefrom. In its basic aspects, the ball carrier of the present invention comprises a continuous raceway that is adapted to confine a plurality of balls for rolling motion over a predetermined continuous or endless path. Gate means are provided along the raceway for enabling the selective removal of balls from or addition of balls to the raceway. Because the raceway is continuous, the balls contained thereby can be moved along the same until a selected ball is positioned at the gate. Such selected ball can then simply be removed by opening the gate.

Most desirably, the raceway is provided by a plurality of continuous rods, preferably annular rods, arranged in inner and outer pairs and between which balls can ride. While such continuous rods will engagee the balls and tend to confine them along a continuous predetermined path, they will engage only a minimum surface area on each ball. The result is that substantially the full surface area of each ball is visible, thereby facilitating selection of a ball having the desired characteristics. The rods are spaced apart by distance less than the diameter of the balls to prevent escape thereof from the raceway by passing between the rods.

The continuous raceway is toroidal, and the gate is mounted on the outside surface of the toroid so that ready access is provided for admitting or removing balls from the raceway. The opening for the gate can be formed by providing spread apart or outwardly enlarged portions at opposed locations on the two outer rods to space the same apart at such locations by a distance greater than the diameter of the ball. A movable gate is also included for closing the opening by normally extending over the area of enlargement to prevent balls from passing therethrough.

The ball carrier of the invention has the above features and advantages while yet being simple and inexpensive to construct. It also has other advantages and featurs which will become apparent from the following more detailed description of a preferred embodiment.

BRIEF DESCRIPTION OF THE DRAWINGS

With reference to the accompanying drawing:

FIG. 1 is a plan view of a preferred embodiment of a ball carrier of the invention;

FIG. 2 is a side elevation view of the preferred embodiment illustrated in FIG. 1 looking from a plane indicated by the line 2—2 in FIG. 1;

FIG. 3 is another side elevation view of the preferred embodiment of FIG. 1 looking from a plane indicated by the lines 3—3 of FIG. 1;

FIG. 4 is an enlarged partial view of that portion of the preferred embodiment enclosed by the circle 4—4 in FIG. 3 and illustrating the gate for the carrier; and FIG. 5 is an enlarged partial view of the portion of the preferred embodiment enclosed by the circle 5—5 in FIG. 1 depicting the manner in which the gate is pivotally mounted to the remainder of the carrier.

DETAILED DESCRIPTION OF THE PREFERRED EMBODIMENTS

A preferred embodiment of a carrier of the invention for holding a plurality of baseballs or the like is generally referred to in the accompanying drawing by the reference numeral 11. Such carrier defines a continuous raceway adapted to confine a plurality of baseballs for rolling motion over a predetermined continuous path. The raceway is generally torroid with its outer limits defined by a plurality of annular rods located in parallel planes which are spaced appropriate distances apart so that each of the rods will engage any ball placed between the rods and tend to maintain the same therebetween. More particularly, four annular rods 12, 13, 14 and 16 are provided with one pair thereof, rods 12 and 13, having equal diameters which are greater than the diameter of the other rods to define the exterior periphery of the torroidal raceway. The other pair of rods 14 and 16, also have equal diameters and define the inner periphery of the raceway.

In order that a ball cannot escape from the raceway by passing between adjacent rods, the distance between adjacent rods should be less than the diameter of the balls to be held. The result is that two adjacent rods (i.e., the paired inner or paired outer rods) will engage the surface of any ball and maintain the same in the raceway as well as act as rails or runners upon which the ball can move within the raceway. In this connection, it is to be noted that, as is shown in FIG. 2, the spacing between the planes defined by the rods 14 and 16 at the inner periphery of the raceway is greater than the spacing between the planes defined by the exterior periphery rods 12 and 13. This enables the rods 14 and 16 to be closer to the rods 12 and 13, respectively, and yet still be positioned to define the torroidal path for the ball.

It has been found that the quickest and most efficient movement of balls around the path is obtained when the balls ride on two adjacent rods which are fairly close to one another. That is, such rods 14 and 16 cooperate with the respectively adjacent rods 12 and 13 to provide efficient raceways for the ball whenever the carrier is oriented in the horizontal position shown in FIG. 2. This close spacing of the rods 14 and 16 to the respective rods 12 and 13 is obtained even though the rods 12 and 13 have a sufficiently great diameter to be positiond fairly far outward along the torroid path to provide protection for the balls around the exterior periphery of the carrier. It should further be noted that this greater spacing between the planes defined by the rods 14 and 16 locates such rods near the upper and lower side surfaces of the path to provide protection for the balls at such locations as well.

The annular rods 12–16 are maintained in their spaced relationship defining the torroidal path by a plurality of spaced apart rings 16 which extend radially of the raceway and circumscribe the torroid at discrete locations. More particularly, four of such circumscribing rings 17 are illustrated equally spaced about the torroid at positions which are spaced generally 90 degrees apart relative to the center of the torroid. Such rings can be formed from the same rod material from which the rods 12–16 are formed, and the rods 12–16 can be secured thereto in any suitable manner as by welding. Because the rings 17 circumscribe the rods and, hence, circumscribe the torroidal raceway, they extend radially outward beyond the rings to provide protection for the rings 12–16 and any balls located therebetween.

Gate means are included as a part of the raceway for selectively admitting and removing balls from between the annular rods. To form the opening for the gate, as is best seen the FIGS. 3 and 4, the exterior pair of rods 12 and 13 are spread outwardly away from one another at opposed locations to form spread-apart, arcuate portions 18 and 19, respectively, with a distance therebetween greater than the diameter of the balls to be held. More specifically, the arcuate portions 18 and 19 are provided by bending the rods 12 and 13 outwardly and generally perpendicularly from the plane each rod otherwise defines to provide the outer reaches of a circular opening having a greater diameter than that of the balls; the center of the opening being at a point midway between the rods 12 and 13. It will be seen that with this construction the rod 12 and 13 do not hinder passage of balls into and out of the raceway at the location of the arcuate portions 18 and 19.

A gate, generally referred to by the reference numeral 21, is provided for normally closing the opening provided by the arcuate portions 18 and 19. More particularly, aligned ears 22 and 23 project outwardly of the raceway from annular rods 12 and 13, respectively, at locations adjacent the arcuate portions 18 and 19. Such ears receive the opposite ends of a pivot pin 24 which extends between the rods 12 and 13 to provide a hinge for the gate. A generally V-shaped gate rod 26 has its free ends 27 and 28 suitably secured, such as by welding to the hinge pin 24 and extends across the circular gate opening provided by the arcuate portions 18 and 19. A stop pin 29 is mounted via ears 31 and 32 between the annular rods 12 and 13 on the side of the gate opening opposite that on which the pivot end 24 is mounted. It will be seen that such stop pin 29 acts as means for limiting pivoting of the gate rod 26 into the raceway.

Spring means are provided for normally spring loading the gate rod 26 into a closed position with its free end in engagement with the stop pin 29 so as to prevent unwanted escape of balls from the raceway. More specifically, a spiral torsion spring 33 coaxially surrounds the pivot pin 24 with its opposite ends 34 and 36 engaged, respectively, with the leg 28 of the rod 26 and the ear 23. As is illustrated, the direction of winding of the spring 33 is such that the spring tends to resist pivoting of the gate rod 26 away from the raceway into its open position. The torsion applied to the spring 33 should be sufficiently high to normally maintain the gate rod in the closed position. Most desirably, such torsion is sufficiently great that the gate is held in the closed position with ample force to resist opening when the raceway is full of balls and the carrier is oriented as shown in FIG.1 with the gate at the bottom thereof. With the carrier in such position, it will be seen that the majority of the weight of all of the balls will bear against the gate and tend to force the same open.

It should be noted that in the described arrangement, the gate is provided on the exterior periphery of the torroid. This facilitates access to the gate for opening or closing to admit or remove balls. Moreover, because the carrier provides a continuous raceway or path over which the balls confined thereby can be moved, it facilitates removal from the carrier of any one selected ball without the necessity of having to remove other balls or of sorting through them. That is, one need only select the desired ball and then roll it around to the gate in order to effect its removal from the raceway. This enables new and used balls to be mixed within the carrier while yet simplifying the removal of an appropriate ball either for playing a game or for practice. Moreover, since the continuous path of the carrier is provided by the rods 14–16, substantially the full surface of each ball is visible for inspection. That is, the rods 12–16 confine the balls by only engaging the same at discrete points along their outer surfaces, and the remainder of such surfaces are visible for examination. For inspection of the full surface of a ball, the ball need simply be rolled along the raceway to expose those portions which might be hidden when it is stationary.

It will be seen that the ball carrier of the invention has the above features and yet is simple and inexpensive to construct. All of the parts, except for the gate spring 26 and the pivot and stop pins 29 and 24, are merely hoops made of wire and can be rapidly and inexpensively mass produced. In this connection, only three different diameters of such hoops are needed to completely construct the carrier.

While a preferrd embodiment of the invention has been descirbed in detail, it will be apparent to those skilled in the art that changes and modifications can be made without departing from its scope. It is therefore intended that the protection afforded applicant be limited only be the claims.

What is claimed is:

1. A carrier for holding a plurality of baseballs or the like comprising a continuous raceway of generally torroidal configuration having means to confine a plurality of balls for rolling motion over a predetermined endless path, means for permitting visual examination of the plurality of balls confined in said raceway, and gate means along a minor portion of said torroidal configuration of only said raceway for admitting balls thereinto and for removing individually selected balls therefrom wherein a ball selected after visual examination may be individually located said gate means for removal without prior removal of other balls.

2. The ball carrier for holding a plurality of baseballs or the like according to claim 1 wherein said gate is mounted on an outside surface thereof to facilitate access thereto for admission and removal of balls into and from said raceway.

3. The carrier for holding plurality of baseballs or the like according to claim 2 wherein spring means are provided for normally spring loading said gate into a closed position with sufficient force to resist opening of said gate by the weight of a full load of balls within said raceway when said raceway is oriented with said gate located at the bottom thereof.

4. The carrier for holding a plurality of baseballs or the like according to claim 1 wherein said raceway is defined by a plurality of substantially endless spaced apart rods along which balls can ride in engagement therewith, said spaced rods defining an open structure comprising said means for permitting visual examination of the balls in said raceway.

5. The carrier for holding a plurality of baseballs or the like according to claim 4 wherein each of said rods is annular, and wherein a plurality of angularly spaced rings extending radially of said torroidal raceway and circumscribing the same at discrete locations are secured to each of said rods to maintain the same in such spaced relationship.

6. The carrier for holding a plurality of baseballs or the like according to claim 4 wherein said rods comprise two pairs respectively defining the exterior periphery and inner periphery of said raceway.

7. A carrier for holding a plurality of baseballs or the like comprising a continuous raceway adapted to confine a plurality of balls for rolling motion over a predetermined endless path, and gate means along said raceway for selectively admitting balls thereinto and removing balls therefrom, wherein said raceway is defined by a plurality of substantially endless spaced apart rods along which said balls can ride in engagement therewith, said rods comprising two pairs respectively defining the exterior periphery and inner periphery of said raceway, wherein said pair of rods defining the inner periphery of said raceway are spaced apart from one another traversely by a distance greater than the corresponding spacing between the pair of rod defining the exterior periphery.

8. A carrier for holding a plurality of baseballs or the like comprising a continuous raceway adapted to confine a plurality of balls for rolling motion over a predetermined endless path, and gate means along said raceway for selectively admitting balls thereinto and removing balls therefrom, wherin said raceway is defined by a plurality of substantially endless spaced apart rods along which said balls can ride in engagement therewith, said rods comprising two pairs respectively defining the exterior periphery and inner periphery of said raceway, wherein the opening of said gate means is defined by the exterior pair of said rods having opposed outwardly spread arcuate portions which define a circular opening therebetween having a diameter greater than the diameter of the balls to be held, said gate means also including a gate pivoted on an axis extending between said pair of rods adjacent one side of said circular opening and spring means resiliently urging said gate to a closed position blocking said opening and preventing escape of balls therefrom, said spring means urging said gate to said closed position with sufficient force to resist opening of said gate by the weight of a full load of balls within said raceway when said raceway is oriented with said gate at the bottom thereof.

* * * * *